United States Patent [19]

Pomper, deceased

[11] 3,980,043

[45] Sept. 14, 1976

[54] PRESSURE-TYPE LIQUID COATING APPLICATOR

[75] Inventor: Anthony W. Pomper, deceased, late of Edison, N.J., by Hortense Head Pomper, executrix

[73] Assignee: Midland-Ross Corporation, Cleveland, Ohio

[22] Filed: Feb. 25, 1975

[21] Appl. No.: 553,001

[52] U.S. Cl. ..... 118/60; 118/259; 118/262; 118/414; 118/610

[51] Int. Cl.[2] ..... B05C 1/08; B05C 3/18; B05C 11/10

[58] Field of Search ..... 118/262, 259, 414, 202, 118/410, 600, 603, 610, 413, 60; 101/366

[56] References Cited

UNITED STATES PATENTS

| | | | |
|---|---|---|---|
| 1,994,269 | 3/1935 | Bonniksen | 118/610 X |
| 2,337,721 | 12/1943 | Kokay | 118/262 X |
| 2,513,394 | 7/1950 | Barrett et al. | 118/262 X |
| 2,830,555 | 4/1958 | Barrett | 118/262 X |
| 3,113,884 | 12/1963 | Kohler | 118/410 X |
| 3,418,970 | 12/1968 | Phelps et al. | 118/413 X |
| 3,511,693 | 5/1970 | Davidson | 118/259 X |
| 3,640,245 | 2/1972 | Schaefer | 118/259 |
| 3,722,469 | 3/1973 | Bartley et al. | 118/414 |

*Primary Examiner*—John P. McIntosh
*Attorney, Agent, or Firm*—Woodrow W. Portz

[57] ABSTRACT

Web coating apparatus wherein a liquid coating material is pressure fed upwardly into the nip of rolls rotating in opposite directions through the nip by structure which prevents contact of the coating material with the atmosphere, enables desired temperature control, and enables vacuum degasing of coating material prior to being pressured into a region adjacent to nip. This coating apparatus is particularly suitable for applying molten resinous compositions to webs.

5 Claims, 7 Drawing Figures

FIG.1
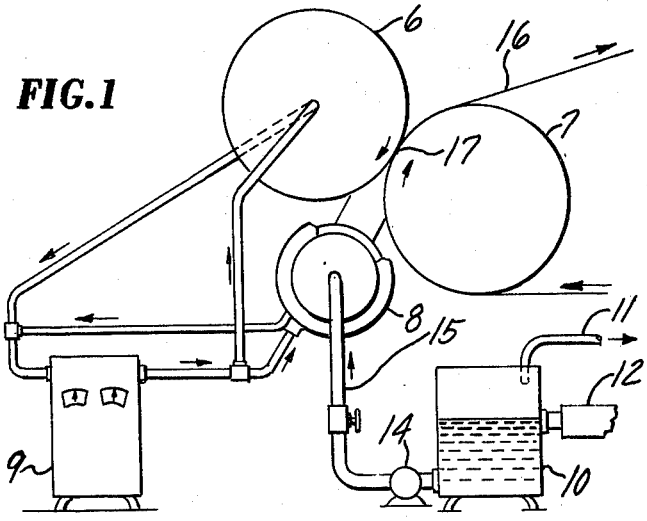
FIG.2
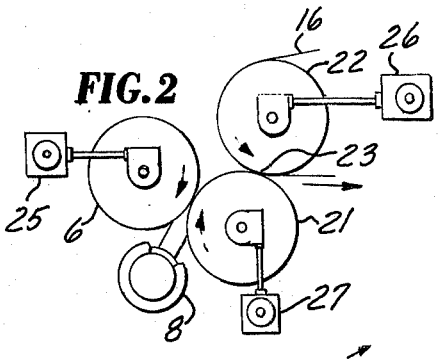
FIG.3
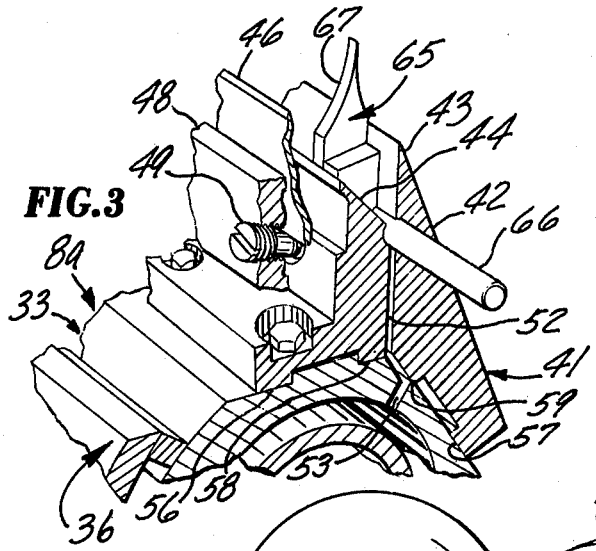
FIG.4
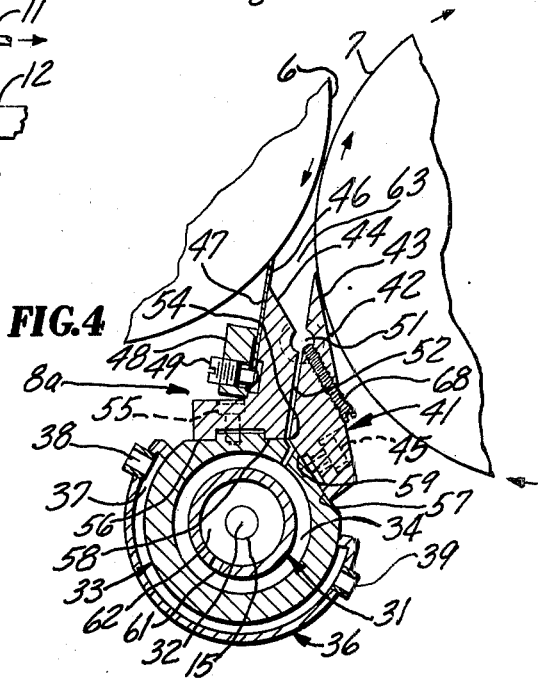
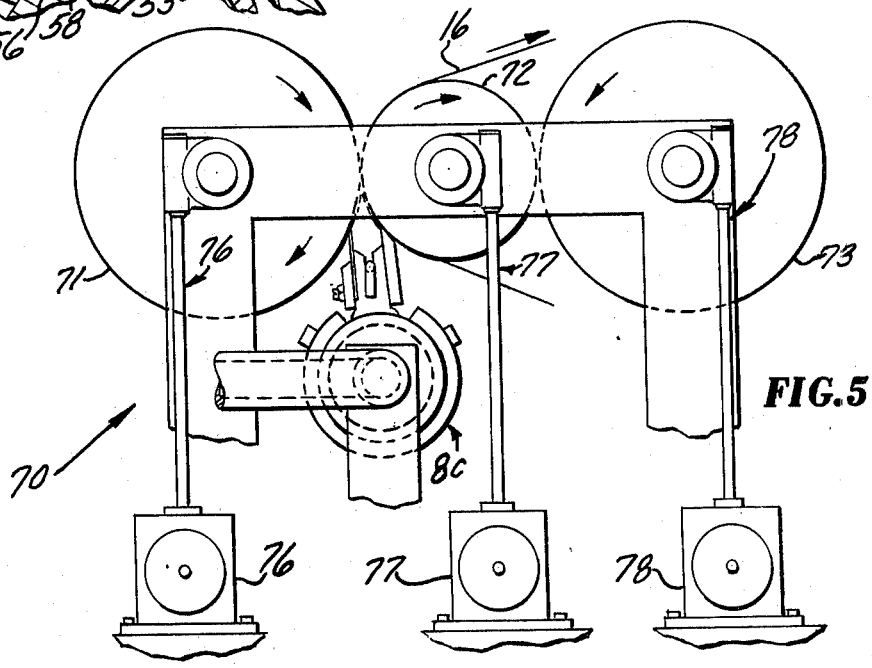
FIG.5

PRESSURE-TYPE LIQUID COATING APPLICATOR

BACKGROUND OF THE INVENTION

Objects of the invention are to provide coating apparatus which includes structures: (1) for applying melted resinous compositions which minimizes contact with air and can eliminate a film of air carried by a high-speed web into the zone of coating application; (2) for simple and effective width control in the application of the coating to the web; for enabling any leakage at the dams to flow by gravity to a catch pan rather than to be leaked onto rolls or a web entering or leaving the coating zone; (3) for eliminating excesses of coating which need to be recirculated and filtered; (4) for delivering a supply of coating under pressure to the applicator without the possibility that any leakage sustained will damage the web; (5) which result in a fountain-forming device which is simple and easily disassembled for cleaning; (6) which can subject the coating material to vacuum degasing along the supply route; (7) which result in a fountain-forming device providing good temperature and viscosity control; and (8) which provide a fountain-forming device structured for very limited distance in time of exposure of the web to coating action within the fountain so as to prevent cooling or heating of the fountain.

Coated web manufacturers are increasingly interested in applying hot-melt coatings to paper, foils, and films instead of solvent-based coatings which require fume incineration to avoid air pollution. Prior art coater types available are extrusion slot-type coaters, reverse-roll and backing roll combination types, and roll application types with knife or sickle bar doctoring off the excess from the coated web.

Conventional coaters comprise a coating carrier roll in nip relation with a reversely rotating metering roll in combination with a bath of melted resinous composition supported over the nip of the rolls for applying hot melt coatings. Though such a coater works well, there are several disadvantages. Some resinous compositions are subject to oxidation when melted and exposed to air. In a conventional coater wherein the coating liquid is gravity fed into the nip of two rolls, the pool of melted coating material is circulated in a rolling motion by the peripheries of the rolls moving through the nip in opposite directions. Air is thus pumped by the moving web and such rolling movement into the coating material supported over the nip. Another disadvantage associated with a coating bath or pool supported over the coating-forming rolls is the difficulty of keeping the dams from leaking to some degree. The leakage, even though small, can get on the backing roll and may work downward onto the web and cause damage thereto. During shutdowns, the web must be kept running until the puddle has run out before the apparatus can be shutdown. Furthermore, the coating action cannot be promptly stopped in the case of a web break or a splice passing through the nip.

SUMMARY OF THE INVENTION

The present invention resides in web coating apparatus comprising in its simplest form a carrier roll having as its main function to receive a coating of metered thickness applied directly to the surface of the roll or to a web carried thereon, and a metering roll in nip relation with the carrier roll rotating through the nip in a direction opposite to that of the carrier roll. The carrier roll may function either as a backing roll for the web or a coating transfer roll. The apparatus further includes a liquid-applying assembly located along the underside of the nip to enclose a substantially sealed region contiguous with areas of both rolls adjacent to the underside of, and extending into the nip.

In a preferred form of the invention, the liquid applicator includes a doctor blade extending upwardly into continuous engagement with a longitudinal portion of the metering roll to thereby clean the surface of the metering roll in a way preventing the escape of coating material from the body thereof contained by the applicator. The applicator further includes a wall or dike in supported spaced parallel relation with the doctor blade and in continuous uniform proximity with a longitudinal portion of the carrier roll. Such proximity may involve little or no clearance, or sufficient closeness to the carrier roll to squeeze air from a web carried thereon. Preferably, the coating material is fed through a manifold for supporting the doctor blade and the dike wall into a coating receiving region therebetween. The body of liquid supported in this region is referred to herein as the "fountain." The liquid applicator may comprise a duct portion having its length coextensive with that of the manifold for transmitting liquid into the region adjacent the rolls along the entire length thereof. The duct portion is jacketed so that it may be substantially enclosed with a heat exchange liquid, e.g., a heated liquid capable of maintaining a resinous coating composition at its melting point.

The apparatus of the invention may further include a reservoir for receiving a coating composition from an extruder or other plasticizing device acted on simultaneously by a vacuum source for degasing any material within the reservoir, and by a pump for transferring material from the reservoir to the coating material applicator.

BRIEF DESCRIPTION OF THE DRAWINGS

FIG. 1 is a schematic elevation of apparatus for applying a liquid coating material to a web passing through the coating-material fountain wherein a backing roll is in nip relation with a metering roll.

FIG. 2 is a schematic elevation of a transfer roll system for coating a web incorporating the invention wherein a backing roll is in nip relation with a transfer roll.

FIG. 3 is a fragmentary perspective view of a liquid-coating fountain-forming dispenser.

FIG. 4 is a fragmentary section view in elevation showing the dispenser of FIG. 3 in combination with a metering roll and a coating pickup roll.

FIG. 5 is a schematic elevation view of web coating apparatus including a modified liquid dispenser for directing a coating fountain upwardly, and a system for individual driving of rolls of the apparatus.

DESCRIPTION OF THE PREFERRED EMBODIMENTS

Figure 6:
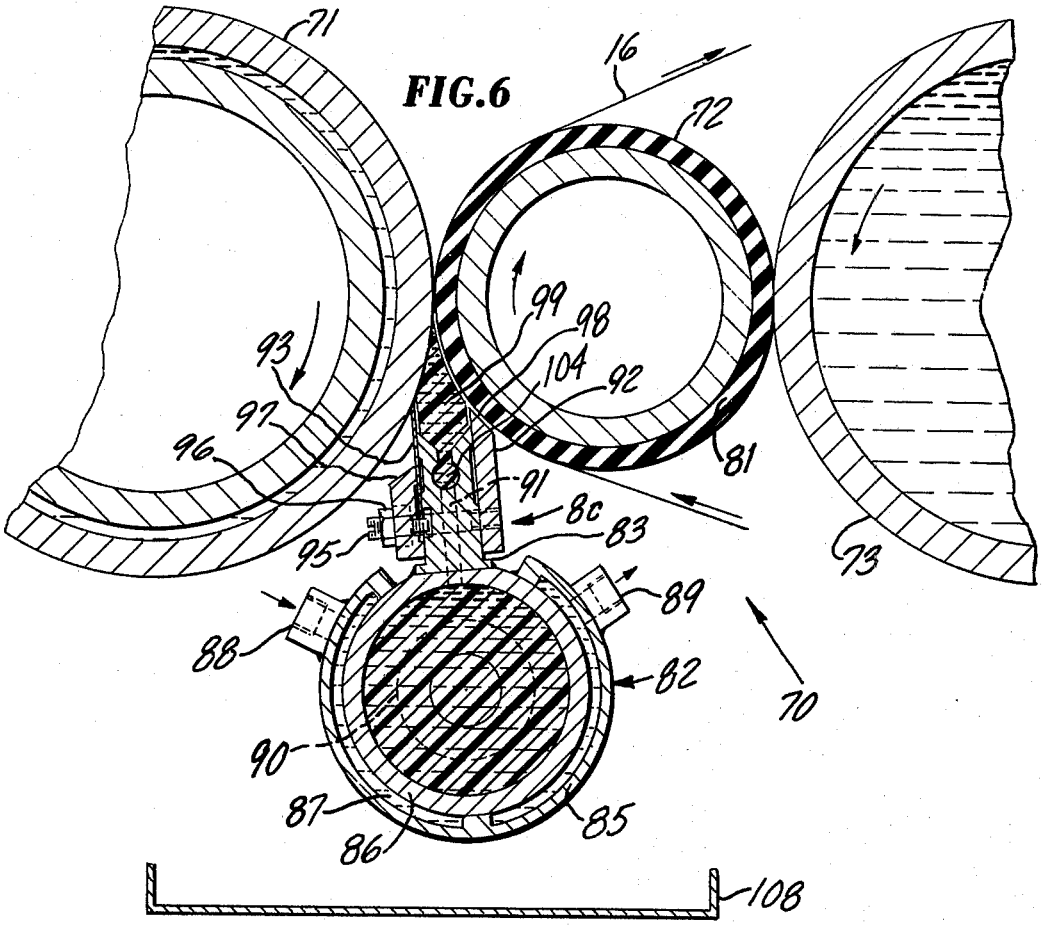
FIG. 6 is a fragmentary enlarged schematic elevation in section of portions of the apparatus as shown in FIG. 5.

FIG. 1 illustrates schematically a general arrangement of web coating apparatus incorporating the invention. This apparatus comprises, as major items, a metering roll 6, a backing roll 7 for forwarding a web through the nip of the rolls 6 and 7, a liquid dispenser 8, a heating and pumping unit 9 for controlling the temperature of a heat exchange liquid circulating through the roll 6 and a jacket chamber of the dispenser 8, a reservoir 10 having an outlet duct 11 terminating in said reservoir and connected with a vacuum source not shown, an extruder 12 for supplying a plasticized resinous composition to the reservoir, and a pump 14 placed in line 15 for transferring material from the reservoir 10 to the dispenser 8. The backing roll 7 forwards a web 16 through a fountain of liquid coating material supported by the dispenser 8 within a substantially sealed region about areas of both rolls adjacent to the underside of, and extending into the nip of the rolls at 17.

FIG. 2 illustrates an alternative coating system in which the web 16 need not pass through the nip of the rolls and an upwardly directed fountain of liquid coating composition formed by the dispenser 8 and the rolls. The system of FIG. 2 comprises, in addition to the dispenser 8 and the metering roll 6, a transfer roll 21 and a backing roll 22 in nip relation with the transfer roll 21. The backing roll is typically constructed with a resilient periphery to provide good frictional relation with the web 16. Roll 7 of FIG. 1 and roll 21 of FIG. 2 are similar in function to the extent that they carry the liquid coating material out of the fountain formed by the rolls and the dispenser as a film of uniform thickness. The two rolls may thus be regarded as a "carrier" roll of the coating material. Roll 22 is shown as rotating in the same direction as roll 21 through the nip at 23. Roll 22 carries the web 16 and may be rotated at a rate slower or faster than that of roll 21, or the web may be passed in a direction through the nip 23 opposite to that of roll 21. The conditions of operation of the rolls 21, 22 are dependent upon many conditions contributing to the nature and rate of deposition of the coating finish desired. To obtain desired speed ratios of the rolls, rolls 6, 22, 21 may be driven by drive units 25, 26, 27, respectively, as shown.

FIGS. 3 and 4 illustrate the construction of a dispenser 8*a* comprising an elongate innermost duct 31 shown in a concentric relation with an axis 32 and in contiguous relation with the supply duct 15, a second duct 33 in outward generally concentric relation with the duct 31 to form a chamber 34 therebetween an outer wall or duct 36 in outward generally concentric relation with the second duct 33 and joined therewith to form a third or jacket chamber 37 enclosed except for outlet and inlet ducts 38, 39. The dispenser 8*a* further comprises an elongate dike for manifold 41 defining a dike 42 having an accurately machined surface 43 for maintaining uniform clearance or sliding engagement with the carrier roll 7 or web carried thereby, a support wall 44 extending in upward diverging relation with the dike 42, a doctor blade 46 secured against an outer carefully planed surface 47 of the wall 44, and a pressure bar 48 bearing on the doctor blade and thereagainst by screws 49 anchored in the manifold. The height of any portion of the doctor blade is adjustable by loosening the screws 49 to reset the blade to a different height and retightening the screws. The dike surface 43 is preferably approximately tangential to the periphery of the roll 7.

The lower edges of downwardly converging inner surfaces of the dike 43 and the wall 44 form an elongate opening into a deckle-rod bore 51 having an axis parallel to the axis 32. The chamber 34 within the heat-exchanging duct structure of the dispenser is connected with the bore 51 by a plurality of passageways or bores 52 spaced lengthwise at regular intervals along a substantial portion length of the manifold 41. The bores 52 communicate with another series of holes 53 arranged in a row parallel to the axis 32. Communication between openings 52 and 53 is facilitated by a clearance 54 between an inner flat manifold surface and an outer surface of the duct 33.

The duct 33 is essentially a tube with flat surfaces machined thereon to receive the manifold 41. Duct 33 and the manifold are secured by two rows of screws 45, 55 to bring about sealing along interfaces at 56, 57, 58, 59. The duct 31 has a row of openings 61 extending through a lengthwise portion thereof so that material fed into the chamber 62 of duct 31 may go through hole 61 into chamber 34 and thus ultimately reach the fountain maintained in the region 63 enclosed by the manifold 41 including the doctor blade, adjacent enclosed areas of the cylinders 6 and 7, and a pair of endwall means exemplified by a deckle dam 65. The deckle dams occur in a "right" and "left" contoured to fit slidably at little or no clearance with the inner surfaces of the doctor blade 46, the inner converging surfaces of wall 44 and dike 42, and adjacent surfaces of the rolls 6 and 7, or roll 21 when used in place of roll 7. Noting deckle dam 65, for example, each dam comprises a rod portion 66 which fits in close leak-proof clearance in slidable relation with the surface of bore 51, and an end wall 67 fixed to the rod 66. The width of coating on the web 16 is governed by the spaced relation of a right and a left deckle dam positioned in the end portions of the region 63. The position of the deckle dams may be fixed by a set screw 68 (see FIG. 4).

Figure 7:
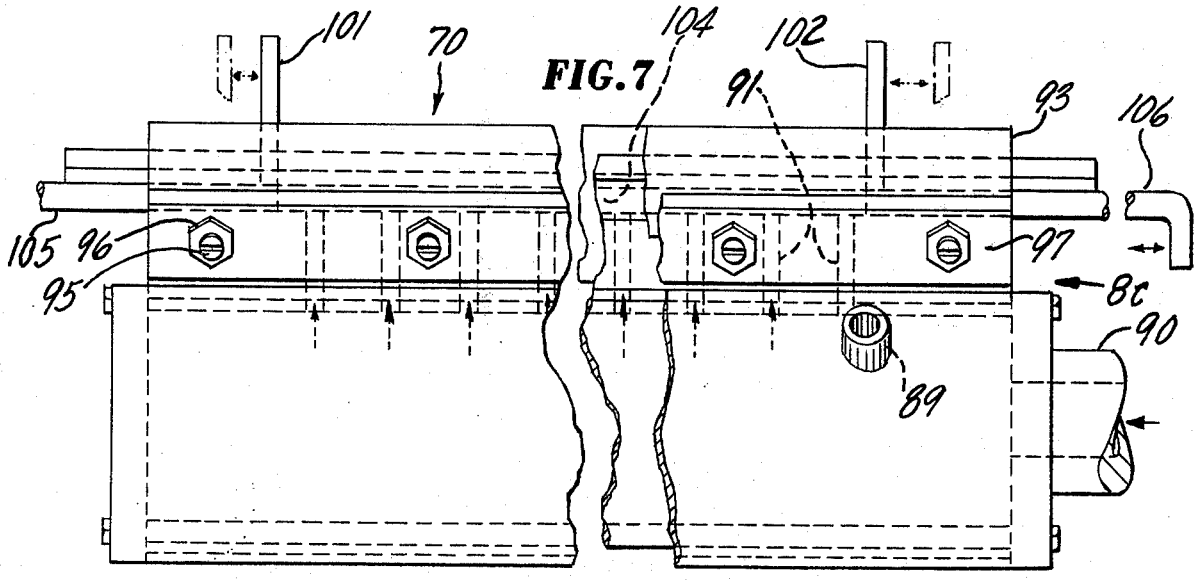
FIG. 7 is a fragmentary shortened side elevation of the liquid dispenser of the apparatus shown in FIG. 6.

FIGS. 5, 6 and 7 illustrate a further embodiment of the invention wherein a coating machine 70 comprises a metering roll 71, a backing roll 72, a heat exchange roll 73 usually a cooling roll, a liquid coating dispenser 74 and a roll-driving assembly 76, 77, 78 for driving rolls 71, 72, 73, respectively. The driving units provide independent adjustment of the peripheral speed of each roll. The metering roll 71 is constructed with a metal peripheral surface carefully machined to an accurate cylindrical shape while the backing roll, such as roll 72 has an outer resilient cover of rubber or rubber-like material to provide a high degree of uniform nip relation with the web 16. Ordinarily, a liquid coolant is circulated through the interior of roll 73 to enable it to extract heat from the surface of roll 72 within the nip of the two rolls. Such cooling enables the surface temperature of roll 72 to be maintained at a level considerably below that which will cause injury or breakdown of the resilient material forming the peripheral cover 81 of the backing roll. Such temperature is typically substantially lower than that of a melted resinous coating composition contained within the dispenser.

The coating dispenser 8*c*, while similar in general construction to dispenser 8*a*, has minor differences of structure. In dispenser 8*c*, a cylindrical heater 82 and a manifold 83 are combined in an integral unit provided with a jacket wall 85 secured to the cylindrical duct 86 to form an annular chamber 87 therebetween through which a heat exchange liquid is circulated between inlet and outlet ports 88, 89. The interior of the duct stores normally molten coating composition received from a supply duct 90 which may be discharged outwardly from the duct through passageways 91. The manifold 83 has a substantially straight parallel side to which a thick doctor blade 92 is adjustably fixed to function as a dike wall, and a relatively thin doctor blade 93 for engaging the surface of roll 71. The two doctor blades are adjustable relative to the manifold 83 and are held against the sides of the manifold by a plurality of studs, such as stud 95, and supporting nuts 96 which bear on a pressure plate 97. As shown, the doctor blade 92 has sufficient thickness to provide a flat surface 98 aligned in substantially tangenital relation with the periphery of roll 72. The surface 98 is supported sufficiently close to the roll 72 to prevent any back flow of material from the fountain 99 through the clearance between the surface 98 and the roll 72 or a web supported on the roll. When the roll 72 carries a web as shown, the surface 98 may ride against the web to express air therefrom as it enters the fountain 99. A small clearance may be maintained between surface 98 and webs which are easily marred by abrasion.

Enclosure of the region for containing the fountain is completed by proper positioning of a pair of deckle dams 101, 102 constructed to fit a cross section of the fountain 99 in non-leaking relation with the manifold 83, the doctor blades, and the rolls 71, 72. The manifold defines a deckle-rod bore 104 into which the passageways 91 discharge and along which portions of the deckle dams, i.e., deckle rods 105, 106 are received. As found in a previous embodiment, the deckle dams are adjustable lengthwise of the bore 104 to vary the width to which a web is coated. Any leakage past the deckle dams finds its way by gravity to a catch basin 108.

The above described embodiments are intended to be exemplary of any coating system in which the coating fountain is directed upwardly into a roll nip in which the rolls thereof move through the nip in opposite directions to apply coating material directly to a web or a transfer roll.

What is claimed is:

1. Web coating apparatus for applying a thin coating of molten resinous composition to a web comprising:

a carrier roll having a resilient peripheral surface for receiving a layer of coating material, and a metering roll having a hard non-resilient peripheral surface arranged in nip relationship therewith, said rolls having axes of rotation contained in a plane extending in angled relation with the vertical;

means for rotating the carrier roll upwardly into said nip, and means for rotating said metering roll downwardly into said nip;

liquid-applying means located along the underside of said nip comprising an upwardly-extending doctor blade in continuous engagement with a longitudinal portion of the periphery of said metering roll; dike means in spaced substantially-parallel coextensive relation with said doctor blade to extend in continuous uniform proximity with a longitudinal portion of said carrier roll; means for positioning said dike means to obtain any desired clearance thereof with said carrier roll; liquid-feeding manifold means supporting said doctor blade and dike means and extending in sealed relation with, and along, the edge portions thereof further away from said rolls; a pair of deckle devices received between opposite end portions of said doctor blade and said dike means, said devices being adjustable toward and away from each other to vary the width of application of coating material to a web; said devices, doctor blade, said dike means, and said manifold means forming an elongate, substantially-sealed, liquid-retaining region about areas of said rolls which are contiguous with said nip and face into said region;

said manifold means comprising supply duct means extending in its longitudinal direction lengthwise of the doctor blade and dike means, the interior of said duct means being connected with said region by transverse passageway means at a plurality of points substantially along the entire length of said region and said duct means; jacket means substantially surrounding said duct means to define a heating chamber for circulating a heat exchange fluid therethrough; circulating means for supplying a heat exchange fluid to said jacket and circulating it therethrough at a desired temperature corresponding to a desired temperature and viscosity of a coating composition;

means for heating and plasticizing a normally solid resinous coating material to a liquid heated condition; and pumping means for forwarding said material from said heating and plasticizing means to said liquid applying means.

2. The apparatus of claim 1 comprising:

reservoir means for receiving and discharging melted coating material in transit between said heating and plasticizing means and said pumping means; and vacuum means connected with an upper portion of said reservoir.

3. The web coating apparatus of claim 1 wherein:

said supply duct means comprises:

a first innermost duct having a longitudinal axis and forming a first chamber adapted for connection with said pumping means;

a second duct in outward generally concentric relation with the first duct forming a second chamber surrounding the first duct; and said jacket means extending around the second duct in outward concentric relation therewith to form said heating chamber enclosed except for inlet and outlet ports adapted for connection to said circulating means;

said manifold means including said second duct being apertured along a longitudinal section extending substantially its full length to provide said passageway means into said region;

said first duct being apertured along a longitudinal section extending substantially along its full length and located approximately 180° about said longitudinal axis from said longitudinal section of said second duct.

4. The web coating apparatus of claim 1 wherein:

said manifold means defines a deckle guide channel opening along one side into said region and extending the full length of the manifold means parallel to said nip; said manifold means further defining said passageway means for feeding a liquid into said channel at a plurality of points therealong;

said deckle devices, each comprising a guide rod having a cross section complimentary to that of said channel and received in said channel, and an end wall element conforming to surfaces of said doctor blade, manifold means, dike means, and said roll areas defining said region, and slidable therealong lengthwise of said guide channel while maintaining substantially sealed relation with said region-defining surfaces.

5. The web coating apparatus of claim 1 wherein:

said carrier roll comprises a peripheral cover of resilient material, and means to cool said carrier roll.

* * * * *